US011376720B2

(12) United States Patent
Hsieh

(10) Patent No.: US 11,376,720 B2
(45) Date of Patent: Jul. 5, 2022

(54) HIGH STRENGTH WRENCH

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 335 days.

(21) Appl. No.: 16/783,311

(22) Filed: Feb. 6, 2020

(65) Prior Publication Data

US 2020/0331129 A1 Oct. 22, 2020

(30) Foreign Application Priority Data

Apr. 16, 2019 (TW) ..... 108113250

(51) Int. Cl.
*B25B 23/16* (2006.01)
*B25B 23/00* (2006.01)
*B25B 13/46* (2006.01)

(52) U.S. Cl.
CPC ..... *B25B 23/16* (2013.01); *B25B 13/462* (2013.01); *B25B 23/0028* (2013.01); *B25B 23/0035* (2013.01)

(58) Field of Classification Search
CPC . B25B 23/16; B25B 23/0028; B25B 23/0035; B25G 1/10
See application file for complete search history.

(56) References Cited

U.S. PATENT DOCUMENTS 6,279,430 B1 * 8/2001 Hsieh ..... B25G 1/063 81/177.1
2007/0151427 A1 * 7/2007 Chen ..... B25G 1/043 81/177.2
2017/0341916 A1 * 11/2017 Wong ..... B25G 1/10
2020/0406432 A1 * 12/2020 Ardente ..... B25B 13/08

* cited by examiner

*Primary Examiner* — David B. Thomas
(74) *Attorney, Agent, or Firm* — Guice Patents PLLC

(57) ABSTRACT

A high strength wrench includes a head portion, a shaft and a handle. A length of the shaft is multiple times of a length of the handle. At least one slot extends along a longitudinal direction of the shaft and is formed at a circumferential surface of the shaft. A cross section shape of the shaft has a structural profile of an outer side with a relatively greater thickness and an inner portion of a relatively smaller thickness. Accordingly, the shaft has a greater structural strength to allow the wrench to bear operations of high torque.

10 Claims, 5 Drawing Sheets

HIGH STRENGTH WRENCH

BACKGROUND OF THE INVENTION

1. Technical Field

The present invention relates to a wrench, in particular, to a wrench having a relatively higher structural strength.

2. Description of Related Art

FIG. 1 shows a conventional ratchet wrench 10 having a head portion 12, a shaft 14 and a handle 16. The head portion includes a ratchet mechanism arranged thereon. During the use, the head portion is used to attach onto a nut, bolt or socket, and the operator can hold the handle and rotate the wrench 10 in order to rotate the nut, bolt or socket.

The lengths of the shaft 14 and the handle 16 of the conventional wrench 10 are about the same, and the moment arm formed by the shaft 14 and the handle 16 is not long. Consequently, the torque generated from the operating of the wrench is not great, and only a small torque can be provided. As a result, such wrench 10 is applicable to the rotation of fastening elements (nuts or bolts) of small sizes only, and it is not suitable to the rotation of fastening elements of large sizes. Furthermore, the shaft 14 of the conventional wrench has no strength reinforcement design such that the structural strength of the wrench is poor, and it cannot bear the operation of high torque. To overcome the drawbacks of the conventional wrench, the inventor designs and develops the present invention through extensive researches.

BRIEF SUMMARY OF THE INVENTION

An objective of the present invention is to provide a wrench in order to allow the wrench to have excellent structural strength such that it is able to bear operations of high torque.

The present invention provides a high strength wrench, comprising:

- a head portion, a shaft and a handle; the head portion connected to a front end of the shaft; the handle connected to a rear end of the shaft; a driving member arranged inside the head portion;
- a length of the shaft configured to be multiple times of a length of the handle;
- at least one slot extending along a longitudinal direction of the shaft and formed at a circumferential surface of the shaft; a cross section shape of the shaft having a structural profile of an outer side with a relatively greater thickness and an inner portion of a relatively smaller thickness.

Accordingly, the shaft is able to have a greater structural strength in order to allow the wrench to bear operations of high torque.

Preferably, a cross section of the slot is arc-shaped in order to prevent sharp edges at the walls of the slot and the condition of stress concentration.

BRIEF DESCRIPTION OF THE SEVERAL VIEWS OF THE DRAWINGS

The following provides description of preferred embodiments of the present invention along with the accompanied drawings as described below.

DETAILED DESCRIPTION OF THE INVENTION

Figure 2:
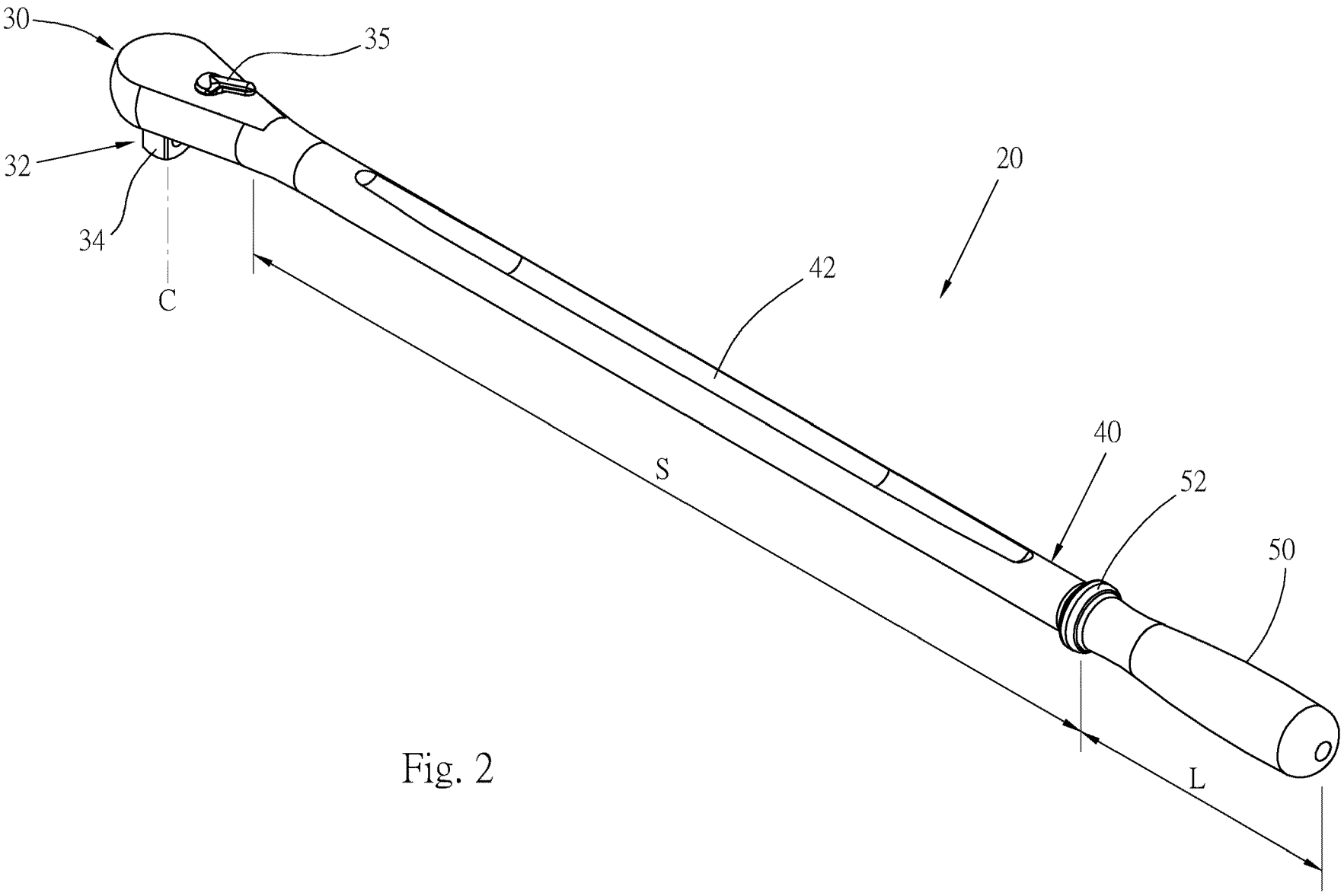
FIG. 2 is a perspective view of the wrench according to the first preferred embodiment of the present invention.
Figure 3:
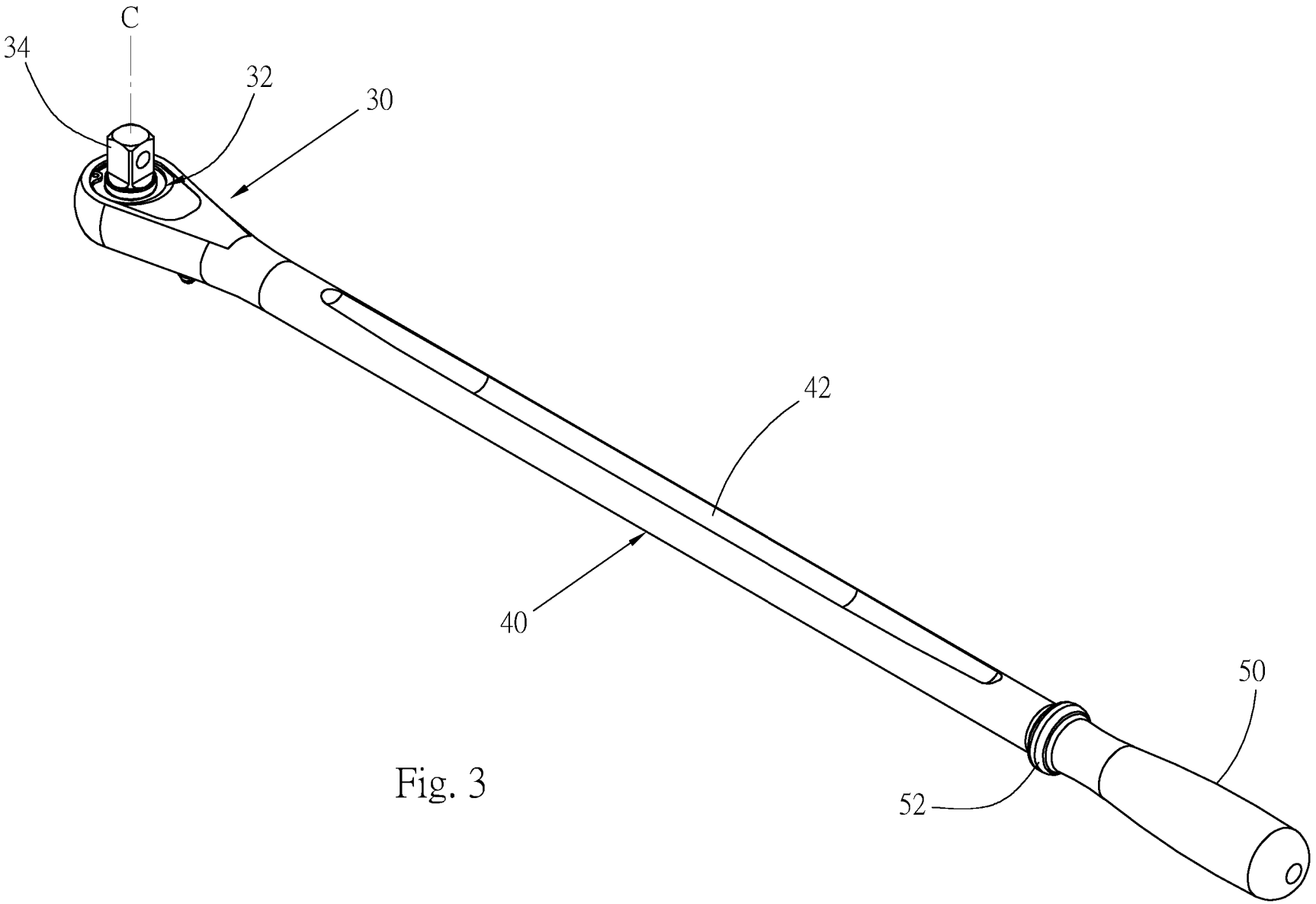
FIG. 3 is a perspective view of a bottom view of FIG. 2.

As shown in FIG. 2 and FIG. 3, according to a first preferred embodiment of the present invention, a wrench 20 made of a metal material is provided and comprises: a head portion 30, a shaft 40 and a handle 50. The rear end of the head portion 30 is arranged at the front end of the shaft 40, and the handle 50 is arranged at the rear end of the shaft 40. In this preferred embodiment, the shaft 40 and the handle 50 are connected to each other via an integral formation method. Alternatively, they can also be manufactured individually, followed by attaching them onto each other. The head portion 30 and the shaft 40 can be integrally formed as shown in this preferred embodiment. Alternatively, they can also be formed as shown in the wrench 20' of FIG. 6, in which the rear end of the head portion 30' and the front end of the shaft 40' are pivotally attached onto each other via a pivotal shaft 41 in order to allow the head portion 30' to rotate relative to the shaft 40'.

Figure 4:
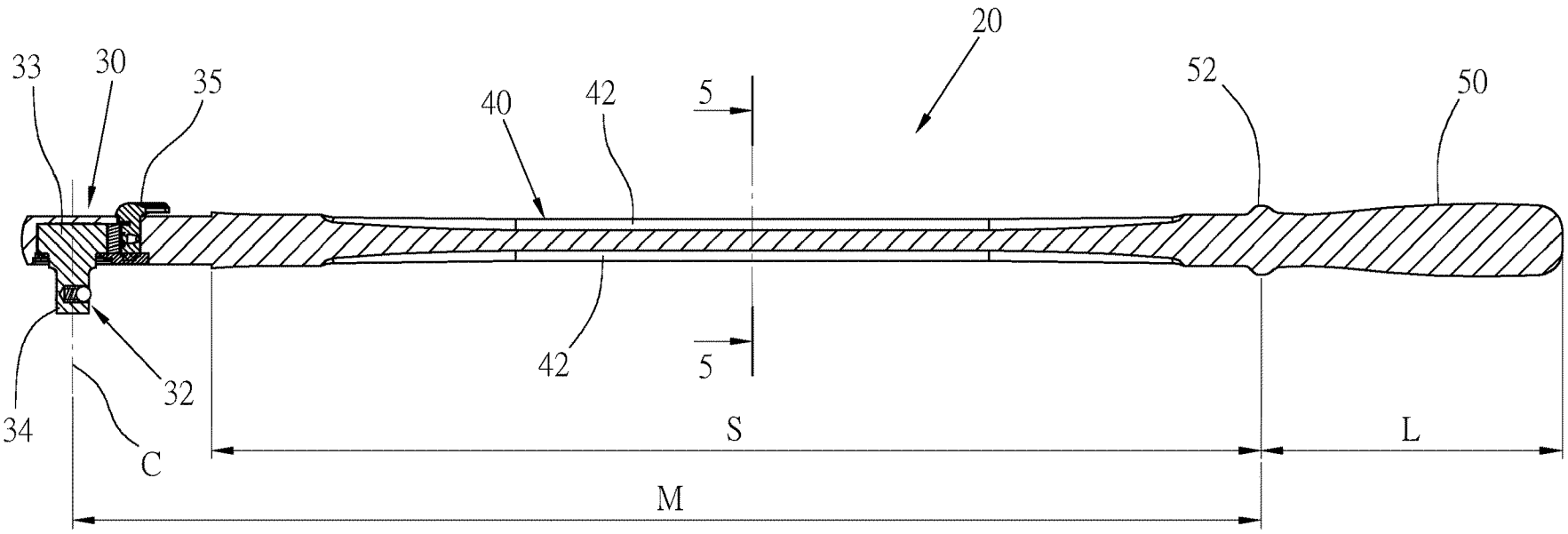
FIG. 4 is a longitudinal cross sectional view of the wrench according to the first preferred embodiment of the present invention.

A driving member 32 is arranged inside the head portion 30 and is configured to attach with and drive a fastening element of nut or bolt etc. or a socket. The driving member 32 can be an insertion column or a polygonal fitting hole or other forms. In this embodiment, the driving member is a ratchet member having a ratchet 33, as shown in FIG. 4. The ratchet 33 has an insertion column 34 in order to be attached with a socket. A direction switch button 35 arranged on the head portion can be used to control a rotational direction of the ratchet 33. The driving member 32 is not the main creation subject matter of the present invention, details thereof is omitted hereafter. The driving member includes a center C, and in this embodiment, the center C of the driving member 32 is located at the center of the insertion column 34.

Figure 5:
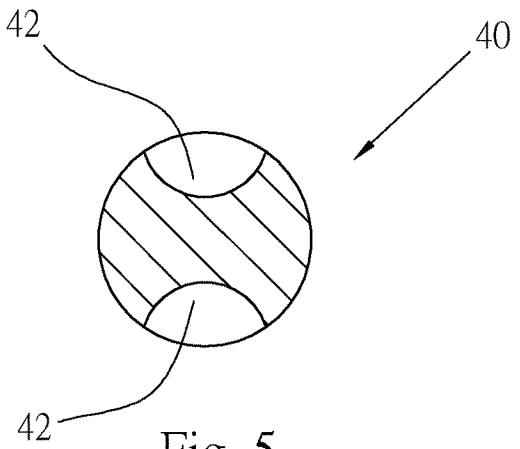
FIG. 5 is a cross sectional view of a shaft taken along the cross sectional line 5-5 shown in FIG. 4.

The shaft 40 can be a solid or hollow structure, and it has a certain length, which can be multiple times of the length of the handle 50. As shown in FIG. 5, the shaft 40 has a cross section of a circular shape; one or more than one slots 42 extended along the longitudinal direction of the shaft 40 and arranged at the circumferential surface of the shaft. In this embodiment, it has two slots 42 formed to recess inward at a top edge and a bottom edge of the shaft respectively. The length of the slot 42 is slightly shorter than the length of the shaft 40. As shown in FIG. 5, with the configuration of the two slots 42, the shaft 40 has a geometric cross sectional shape of an H shape such that the shaft has a structural profile of an outer side with a relatively greater thickness and an inner portion of a relatively smaller thickness. Such type of structural profile design is able to increase the structural strength of the shaft 40 of the wrench 20 and the stress of the shaft. In addition, the cross section of each slot 42 is arc-shaped such that the inner wall of the slot has no sharp edges to prevent the concentration of stress.

The handle 50 can be a solid or hollow structure and has a circular cross section for the operator to hold or grip. A protruding ring 52 with a cross section of a circular shape is arranged at an intersecting area between the shaft 40 and the handle 50. The outer diameter of the protruding ring 52 is greater than the diameter of the shaft 40, thereby increasing the structural strength of the wrench, especially the strength of the shaft.

The length of the shat 40 can be multiple times of the length of the handle 50. A shown in FIG. 4, for the design of the present invention, the length of the shaft is configured to be no less than two times of the length of the handle. In practice, it can be three times or more greater. Preferably, the length S of the shaft 40 is 3.1 times to 3.8 times of the length L of the handle 50. A length M from the center C of the driving member 32 to the rear end of the shaft 40 is three to five times of the length L of the handle 50. Preferably, it is 3.7 times to 4.5 times.

Figure 6:
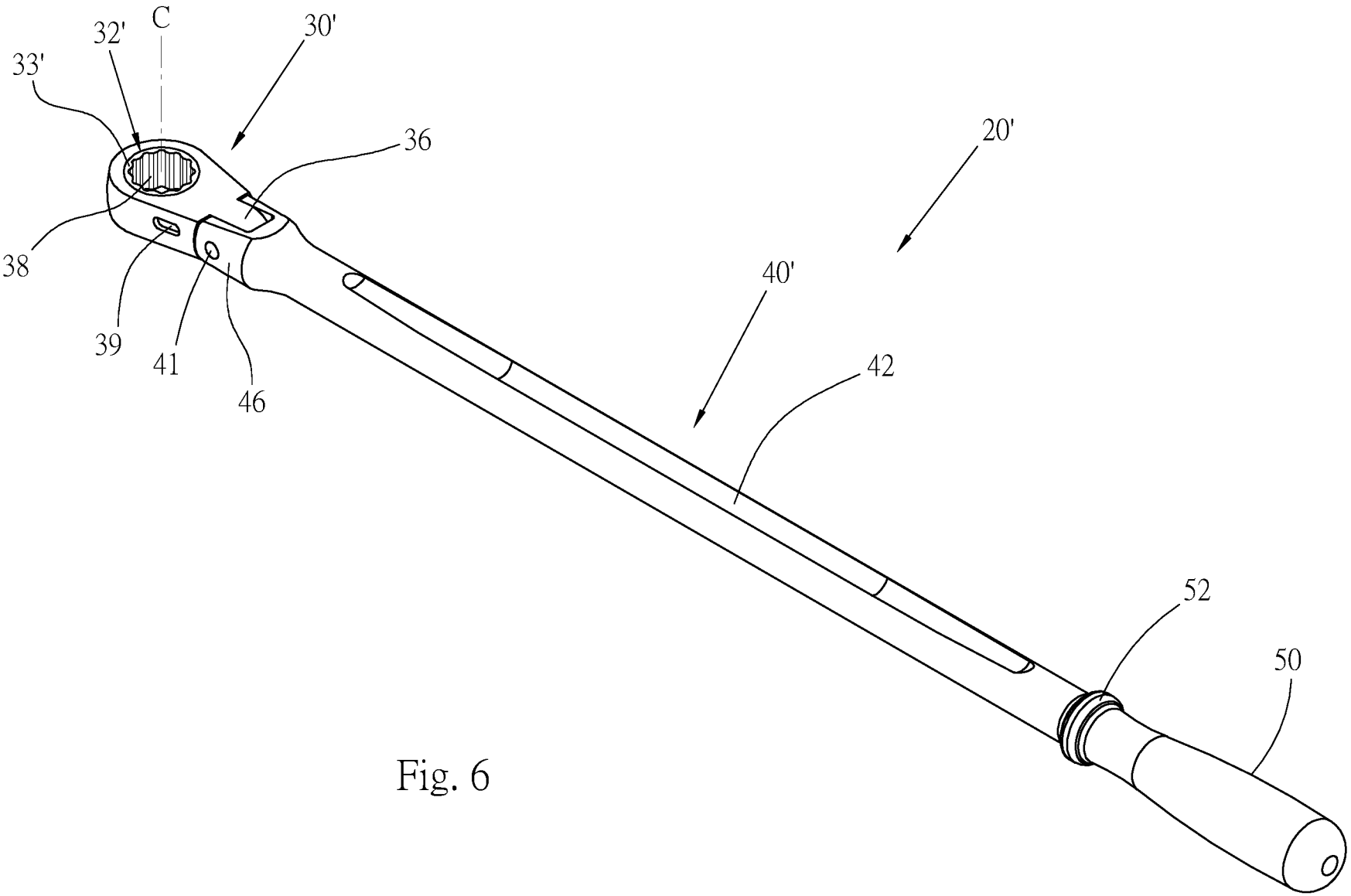
FIG. 6 is a perspective view of the wrench according to the second preferred embodiment of the present invention.

FIG. 6 shows a second preferred embodiment of a wrench 20' of the present invention. The same components are denoted by the reference numerals used in the first preferred embodiment, and for the structural characteristics of the components, please refer to the description of the first preferred embodiment; therefore, details thereof are omitted hereafter.

The wrench 20', similarly, includes a head portion 30', a shaft 40' and a handle 50. A pivotal portion 36 at the rear end of the head portion 30' is pivotally connected with a pivotal portion 46 at the front end of the shaft 40'. The shaft 40' and the handle 50 can be solid or hollow structures. Two slots 42 are formed to longitudinally extend along the shaft at the top edge and the bottom edge of the circumferential surface of the shaft. A driving member 32' is arranged in the head portion 30' and the driving member 32' in this embodiment is also a ratchet member having a ratchet 33'. The ratchet 33' includes a fitting hole 38 of a polygonal shape and used to attach and drive a fastening element or a socket. A direction switch push rod 39 is arranged in the head portion in order to control the rotational direction of the ratchet 33'. The driving member 32' also includes a center C. In this embodiment, the center C of the driving member 32' is located at the center of the fitting hole 38. Similarly, the length of the shaft 40' is no less than three times of the length of the handle 50. Preferably, the length of the shaft 40' is 3.1 times to 3.8 times of the length of the handle 50. The length from the center C of the driving member 32' to the rear end of the shaft 40' is approximately four times of the length of the handle, and preferably, it is 3.7 times to 4.5 times thereof.

Figure 1:
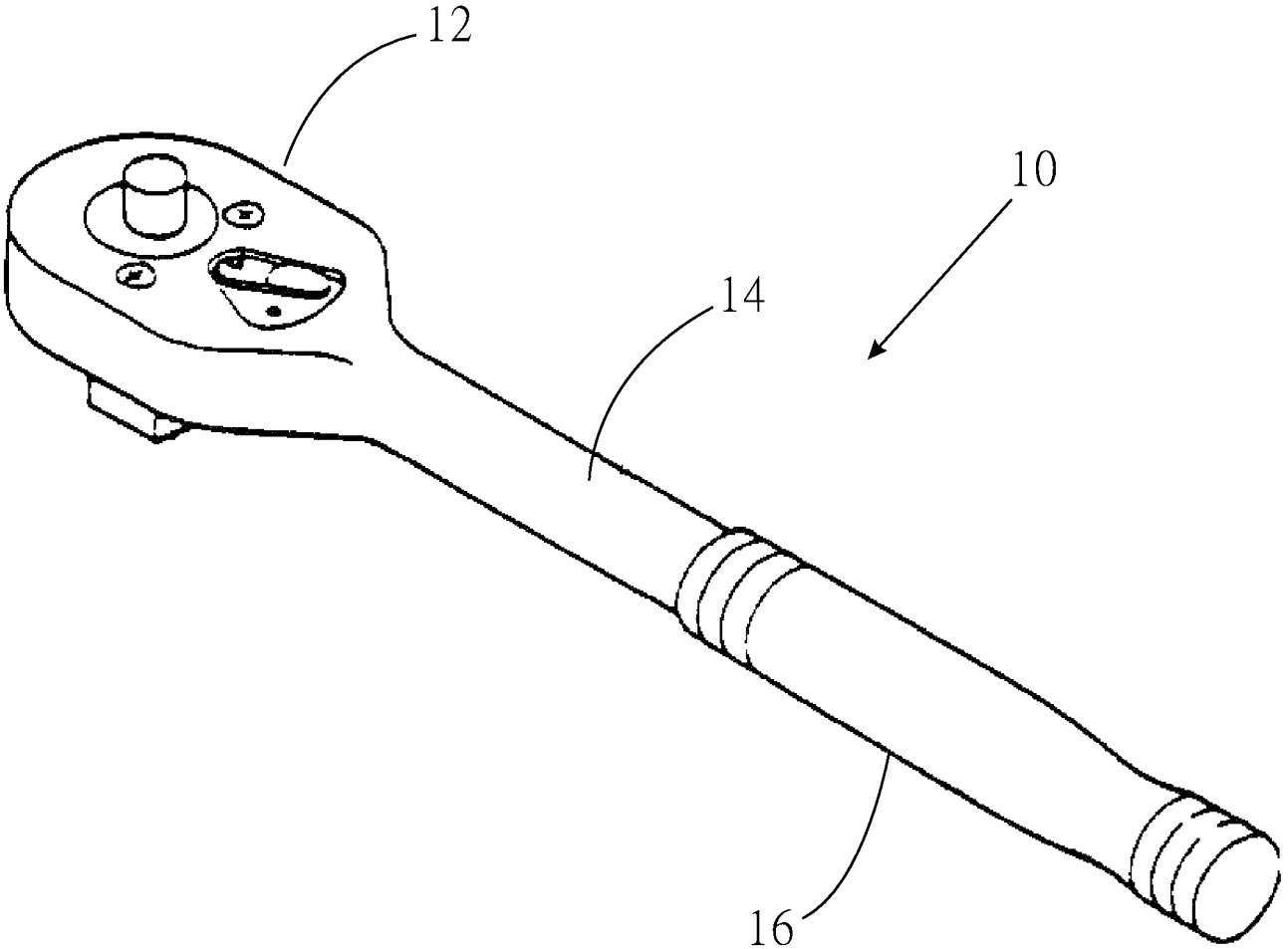
Fig. 1 PRIOR ART
FIG. 1 is a perspective view of a conventional ratchet wrench.

The length M from the center C of the driving member 32 (32') of the present invention to the rear end of the shaft 40 (40') and the length L of the handle 50 form the operating moment arm (i.e. M+L) of the wrench for rotating a fastening element or a socket. The length of the shaft 40 of the wrench 20 of the present invention has a length three times greater than the shaft of a conventional wrench 10 shown in FIG. 1, therefore, the operating moment arm (M+L) is far longer than the moment arm of the conventional wrench 10. With the long operating moment arm, the present invention is able to achieve high torque for rotating fastening elements, and such torque is several times greater than the torque of the conventional wrench.

The structural design of the wrench 20 is able to bear operations of high torque, including: the arrangement of the two slots 42 is able to allow the cross section of the shaft has a specific geometric shape such that the shaft 40 is able to bear the load of high torque without bending or damage despite its long length. In addition, the cross section of the slot 42 adopts the design of a circular arc shape such that the inner wall of the slot has no sharp edges, thereby preventing the concentration of stress and reducing the condition of broken or damaged shaft of the wrench. Moreover, the two slots are able to reduce the weight of the wrench in order to achieve labor-saving effect for the operation.

The aforementioned embodiments are examples disclosed to illustrate the technical features of the present invention only such that they shall not be treated as limitations of the present invention. In addition, all equivalent structural designs of the present invention shall be considered to be within the scope of the present invention.

What is claimed is:

1. A high strength wrench, comprising: a head portion, a shaft and a handle; the head portion disposed to a front end of the shaft; the handle disposed to a rear end of the shaft, the handle and the shaft integrally formed as a single piece; a driving member arranged in the head portion; a length of the shaft configured to be multiple times of a length of the handle; and at least one slot extending along a longitudinal direction of the shaft and formed at a circumferential surface of the shaft; a cross section shape of the shaft having a structural profile of an outer side with a relatively greater thickness and an inner portion of a relatively smaller thickness.

2. The wrench as claimed in claim 1, wherein the length of the shaft is configured to be two times or more than two times of the length of the handle.

3. The wrench as claimed in claim 1, wherein the cross section of the slot is arc-shaped.

4. The wrench as claimed in claim 1, further comprising two slots respectively formed to recess inward at a top edge and a bottom edge of the shaft.

5. The wrench as claimed in claim 1, wherein a length of the slot is slightly shorter than the length of the shaft.

6. The wrench as claimed in claim 1, wherein the driving member has a center; a length from the center of the driving member to the rear end of the shaft is 3 to 5 times of the length of the handle.

7. The wrench as claimed in claim 1, wherein the shaft and the handle are connected to each other via an integral formation method.

8. The wrench as claimed in claim 1, further comprising a protruding ring arranged at an intersecting area between the shaft and the handle; an outer diameter of the protruding ring is greater than an outer diameter of the shaft.

9. The wrench as claimed in claim 8, wherein the cross sections of the protruding ring, the shaft and the handle are circular shapes.

10. The wrench as claimed in claim 1, wherein the shaft is a solid or hollow structure.

* * * * *